US012534250B2

(12) United States Patent
Yang et al.

(10) Patent No.: US 12,534,250 B2
(45) Date of Patent: Jan. 27, 2026

(54) PACKAGING EQUIPMENT AND RETRACTABLE PACKAGING MACHINERY

(71) Applicant: CHENGDU LONGXI TECHNOLOGIES LTD, Sichuan (CN)

(72) Inventors: Xiaowei Yang, Sichuan (CN); Renwang Xiao, Sichuan (CN); Xia Tian, Sichuan (CN)

(73) Assignee: CHENGDU LONGXI TECHNOLOGIES LTD, Sichuan (CN)

( * ) Notice: Subject to any disclaimer, the term of this patent is extended or adjusted under 35 U.S.C. 154(b) by 0 days.

(21) Appl. No.: 18/826,148

(22) Filed: Sep. 5, 2024

(65) Prior Publication Data

US 2025/0083850 A1 Mar. 13, 2025

(30) Foreign Application Priority Data

Sep. 7, 2023 (CN) ..... 202311154216.9
Sep. 7, 2023 (CN) ..... 202322435423.3

(51) Int. Cl.
*B65B 43/54* (2006.01)
*B65B 5/04* (2006.01)
*B65B 43/26* (2006.01)

(52) U.S. Cl.
CPC ..... *B65B 43/54* (2013.01); *B65B 5/045* (2013.01); *B65B 43/26* (2013.01)

(58) Field of Classification Search
CPC ..... B65B 39/10; B65B 43/26; B65B 43/465; B65B 43/50; B65B 43/54; B65B 43/60;
(Continued)

(56) References Cited

U.S. PATENT DOCUMENTS

2010/0192524 A1* 8/2010 Rapparini ..... B65B 31/024 53/284.7
2010/0242972 A1* 9/2010 Thierig ..... B65B 61/28 131/112

(Continued)

FOREIGN PATENT DOCUMENTS

CN 110040292 A 7/2019
CN 113772180 A 12/2021

(Continued)

OTHER PUBLICATIONS

The European Search report issued on May 27, 2025 for EP24198823.7.

(Continued)

*Primary Examiner* — Himchan Song
(74) *Attorney, Agent, or Firm* — Yue (Robert) Xu; Apex Attorneys at Law, LLP

(57) ABSTRACT

Packaging equipment having higher packaging efficiency is provided. The Packaging equipment includes a frame, and a material filling apparatus, a bag loading apparatus, and a bag receiving apparatus that are arranged on the frame. The bag receiving apparatus includes a support assembly and multiple bag holders. The support assembly is rotatably arranged on the frame, and the multiple bag holders are symmetrically arranged on the support assembly with respect to a rotation axis of the support assembly. The bag loading apparatus conveys a packaging bag to each bag holder at a bag loading station, and the bag receiving apparatus drives the packaging bag to rotate from the bag loading station to the material filling station. The material filling apparatus fills material into the packaging bag, and a material filling direction of the material filling apparatus is perpendicular to the rotation axis of the support assembly.

15 Claims, 13 Drawing Sheets

(58) Field of Classification Search
CPC ..... B65B 5/045; B65B 51/146; B65B 65/003; B65B 65/02
See application file for complete search history.

(56) References Cited

U.S. PATENT DOCUMENTS

| | | | | |
|---|---|---|---|---|
| 2015/0266601 | A1* | 9/2015 | Vollenkemper | B65B 1/08 53/384.1 |
| 2015/0284122 | A1* | 10/2015 | Murray | B65B 43/50 248/99 |
| 2017/0291727 | A1* | 10/2017 | Vollenkemper | B65B 63/02 |
| 2019/0300216 | A1* | 10/2019 | Nakamoto | B65B 61/28 |
| 2022/0340320 | A1* | 10/2022 | Nakamoto | B65B 43/60 |
| 2022/0348371 | A1* | 11/2022 | Kawashima | B65B 25/145 |
| 2023/0025364 | A1* | 1/2023 | Nakamoto | B65B 43/60 |
| 2023/0227193 | A1* | 7/2023 | Apol | B31B 50/36 53/456 |
| 2024/0417123 | A1* | 12/2024 | Gressler | B65B 59/005 |

FOREIGN PATENT DOCUMENTS

| | | | |
|---|---|---|---|
| CN | 217436109 | U | 9/2022 |
| CN | 116198797 | A | 6/2023 |
| CN | 117002814 | A | 11/2023 |
| CN | 220743522 | U | 4/2024 |
| DE | 202018100593 | U1 | 2/2018 |
| EP | 4082920 | A1 | 11/2022 |
| WO | 2008114113 | A1 | 9/2008 |

OTHER PUBLICATIONS

International Search Report and Written Opinion of the International Searching Authority issued on Aug. 31, 2024 for PCT/CN2024/095666.

* cited by examiner

PACKAGING EQUIPMENT AND RETRACTABLE PACKAGING MACHINERY

The present application claims the priorities to Chinese Patent Applications No. 202322435423.3, titled "BAG PACKAGING EQUIPMENT", filed with the China National Intellectual Property Administration on Sep. 7, 2023, and No. 202311154216.9, titled "RETRACTABLE PACKAGING MACHINERY", filed with the China National Intellectual Property Administration on Sep. 7, 2023, the entire disclosures of which are incorporated herein by reference.

FIELD

The present application relates to the technical field of packaging technologies, and in particular to packaging equipment and retractable packaging machinery.

BACKGROUND

To facilitate transportation and storage of materials such as foods, groceries, medicines or the like, the materials are expected to be packaged with a packaging bag. When the materials are packaged, an opening of the packaging bag is opened first, and then the materials are put into the packaging bag.

Conventional packaging equipment includes a bag loading apparatus and a bag receiving apparatus. The packaging bag is opened by the bag loading apparatus, and is loaded onto the bag receiving apparatus. Then, the materials are manually filled into the packaging bag, and the packaging bag is removed from the bag receiving apparatus. Finally, the opening of the packaging bag is sealed. In this way, the materials are packaged. The materials have to be filled manually, resulting in relatively low efficiency of material packaging operations, which is not conductive to material packaging in large batches, and is unadaptable to consecutive large-scale production lines.

SUMMARY

A technical problem to be solved and a technical mission proposed according to the present application are to improve the conventional technology, to provide packaging equipment.

To solve the above technical problem, following technical solutions are provided according to the present application.

Packaging equipment includes a frame, and a material filling apparatus, a bag loading apparatus, and a bag receiving apparatus that are arranged on the frame;

- the bag receiving apparatus includes a support assembly and multiple bag holders, the support assembly is rotatably arranged on the frame, and the multiple bag holders are symmetrically arranged on the support assembly with respect to a rotation axis of the support assembly;
- the bag loading apparatus is configured to convey a packaging bag to the multiple bag holders at a bag loading station, and the bag receiving apparatus is configured to drive the packaging bag to rotate from the bag loading station to the material filling station; and
- the material filling apparatus is configured to fill material into the packaging bag, and a material filling direction of the material filling apparatus is perpendicular to the rotation axis.

Further, the support assembly includes a support plate, and the multiple bag holders are arranged on the support plate.

Further, the multiple bag holders are provided on the support assembly along an axial direction of the rotation axis, and multiple bag loading apparatuses and multiple material filling apparatuses are provided on the frame in one-to-one correspondence to the multiple bag holders.

Further, a multiple support plates are provided, and the multiple support plates are evenly arranged around the rotation axis.

Further, an angle between each two adjacent support plates along a circumferential direction of the rotation axis is 30°, 45°, 60°, or 90°.

Further, the each of the multiple support plates includes a connecting plate, the connecting plate is rotatably arranged on the frame, two ends of the connecting plate that are symmetric with respect to the rotation axis are respectively bent by 45° along a rotation direction of the connecting plate to form a first end plate and a second end plate, and the multiple bag holders are symmetrically arranged on the first end plate and the second end plate with respect to the rotation axis.

Further, the bag loading apparatus is configured to load the packaging bag onto the multiple bag holders along a vertical direction when the bag holder is at the multiple bag holders.

Further, the material filling apparatus includes a pushing rod and a slideway structure, the pushing rod cooperates with the slideway structure in a slidable manner, and the pushing rod is configured to push the material in the slideway structure into the packaging bag whose opening of the packaging bag is in an open state.

Further, the packaging equipment includes an output mechanism and a sealing mechanism that are arranged on the frame, the output mechanism is configured to convey the packaging bag filled with the material, and the sealing mechanism is configured to seal the opening of the packaging bag filled with the material.

Further, the bag loading apparatus includes a bag placement mechanism, a bag conveying mechanism, and a bag transfer mechanism, where the bag placement mechanism is configured to store the packaging bag, the bag conveying mechanism is configured to convey the packaging bag inside the bag placement mechanism to the bag transfer mechanism, and the bag transfer mechanism is configured to load the packaging bag onto the multiple bag holders.

Further, each of the multiple bag holders includes a first moving plate and a second moving plate that are symmetrically arranged on the support assembly, and an air cylinder provided on the support assembly. The first moving plate and the second moving plate are hingedly connected to the support plate, and the air cylinder is configured to drive the first moving plate and the second moving plate to rotate close to or away from each other at the same time.

Compared with the conventional technology, the present application has the following advantages. According to the packaging equipment provided in the present application, the support assembly rotates to drive the bag holder to rotate, such that the bag holder moves from the bag loading station to the material filling station. The bag loading apparatus loads the packaging bag onto the bag holder, and the bag holder opens and retains the opening of the packaging bag. The support assembly rotates to drive the packaging bag to move to the material filling station, and the material filling apparatus fills the material into the packaging bag. In this way, the material is preliminarily packaged. With the packaging equipment according to the present application, the material needs not to be manually filled, and therefore the time of manual material filling is saved, the material packaging is accelerated, and the material packaging efficiency is enhanced, which are beneficial to the material packaging in large batches, and is adaptable to consecutive large-scale production lines.

Retractable packaging machinery includes a frame, and a material filling apparatus, a bag loading apparatus, and a bag receiving apparatus that are arranged on the frame;

the bag receiving apparatus includes multiple bag holders and a retractable mechanism, the retractable mechanism is rotatably arranged on the frame, the multiple bag holders are arranged on the retractable mechanism symmetrically with respect to a rotation axis of the bag receiving apparatus, and the retractable mechanism is configured to drive the multiple bag holders to move close to or away from the rotation axis;

the bag loading apparatus is configured to convey a packaging bag to the multiple bag holders at a bag loading station, and the bag receiving apparatus is configured to drive the packaging bag to rotate from the bag loading station to a material filling station;

the material filling apparatus is configured to fill material into the packaging bag, and a material filling direction of the material filling apparatus is perpendicular to the rotation axis of the bag receiving apparatus; and during rotation of the multiple bag holders from the bag loading station to the material filling station, the retractable mechanism is configured to drive a distance between the multiple bag holders at two sides of the rotation axis to decrease first and then increase.

Further, the retractable mechanism includes a rotation shaft, a driving mechanism, a first support plate, and a second support plate;

the rotation shaft is rotatably arranged on the frame, and the first support plate and the second support plate are arranged on the rotation shaft in a slidable manner; and the driving mechanism is configured to drive the first support plate and the second support plate to slide in parallel along a direction perpendicular to the rotation axis, and the multiple bag holders are symmetrically arranged on an end portion of the first support plate and an end portion of the second support plate with respect to an rotation axis of the rotation shaft.

Further, an output end of the driving mechanism is connected to the first support plate and the second support plate, the retractable mechanism includes a guide structure provided on the rotation shaft, the first support plate and the second support plate cooperates with the guide structure in a slidable manner, and the driving mechanism is configured to drive the multiple bag holders to slide on the guide structure close to or away from the rotation axis.

Further, the first support plate and the second support plate are arranged at two sides of the rotation shaft, the first support plate and the second support plate are parallel to each other, and the rotation shaft is arranged between the first support plate and the second support plate.

Further, the driving mechanism includes a first connecting rod, a second connecting rod, and a driving apparatus;

one end of the first connecting rod is hingedly connected to the rotation shaft, and the other end of the first connecting rod cooperates with the first support plate in a slidable manner along an axial direction of the rotation shaft;

one end of the second connecting rod 406 is hingedly connected to the rotation shaft 4016, and the other end of the second connecting rod cooperates with the second support plate in a slidable manner along the axial direction of the rotation shaft; and the driving apparatus is configured to drive the first connecting rod and the second connecting rod to rotate close to or away from the rotation shaft at the same time.

Further, the driving apparatus includes a slide plate, a push-pull rod, and a driver;

the rotation shaft is a hollow shaft, the slide plate passes through the rotation shaft and is arranged on the rotation shaft in a slidable manner along the axial direction of the rotation shaft, and two ends of the slide plate respectively cooperates with the first connecting rod and the second connecting rod in a slidable manner along an extension direction of the first connecting rod and an extension direction of the second connecting rod;

the push-pull rod is arranged inside the rotation shaft and cooperates with the rotation shaft along the axial direction of the rotation shaft, one end of the push-pull rod is fixedly connected to the slide plate, and the other end of the push-pull rod is connected to the driver located at an end portion of the rotation shaft; and the driver is configured to drive the push-pull rod to move back and forth along the axial direction of the rotation shaft to drive the first connecting rod and the second connecting rod to rotate.

Further, the driver includes a driving ring and a driving head;

the driving ring is coaxially connected to the push-pull rod, a cam groove extending along a circumferential direction of the rotation shaft is provided on an outer ring surface of the driving ring, and the driving head is connected to the cam groove in a slidable manner along the circumferential direction of the rotation shaft; and the driving head is configured to rotate along the circumferential direction of the rotation shaft under an external force to drive the driving ring to move back and forth along the axial direction of the rotation shaft; or the driving head is stationary, and the driving ring is configured to rotate along the circumferential direction of the rotation shaft under the external force to be driven to move back and forth along the axial direction of the rotation shaft.

Compared with the conventional technology, the present application has the following advantages. According to the retractable packaging machinery provided in the present application, the bag receiving apparatus includes the retractable mechanism and the bag holder. The retractable mechanism is rotatably arranged on the frame, and the rotation axis of the retractable mechanism is perpendicular to the material filling direction of the material filling apparatus. During rotation of the bag holder from the bag loading station to the material filling station, the retractable mechanism is configured to drive a distance between the bag holder at two sides of the rotation axis to decrease first and then increase, which makes a radius of rotation of the bag receiving apparatus decrease first and then increase. In this way, a space occupied by the bag receiving apparatus is saved, and a moment of inertia of the bag receiving apparatus can be temporarily reduced, thereby improving the using safety of the retractable packaging machinery.

Figure 1:
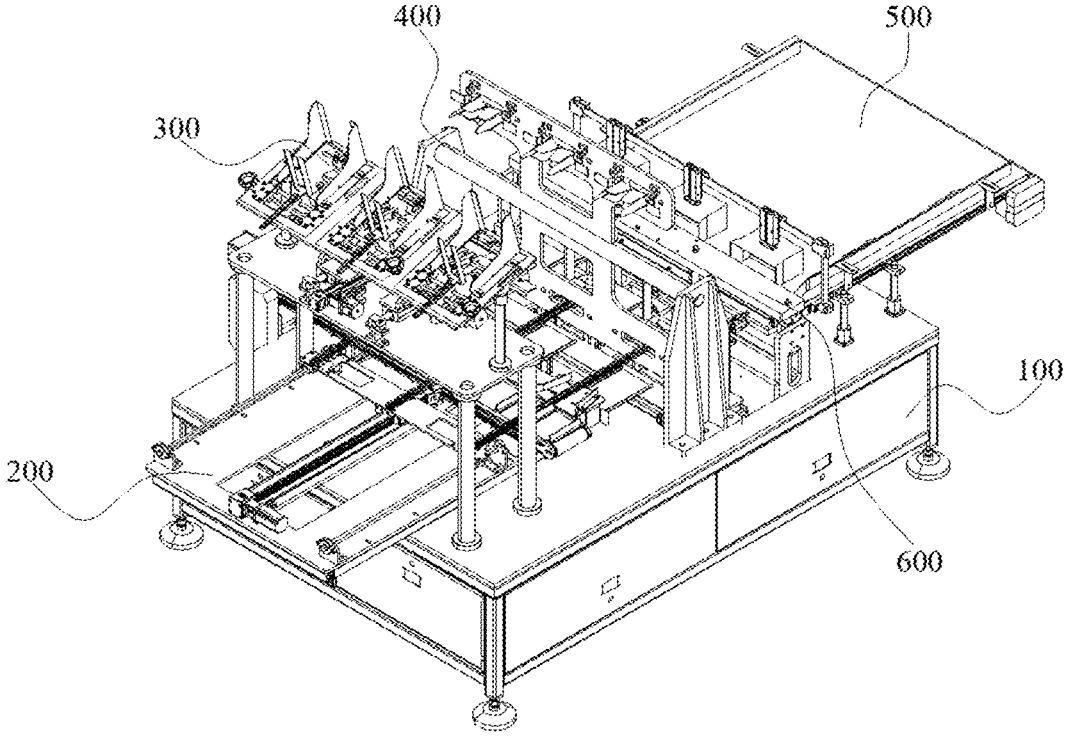
FIG. 1 is a schematic perspective view showing the structure of packaging equipment according to the present application.

Reference numerals:

| | | | |
|---|---|---|---|
| 100 | frame, | 200 | material filling apparatus, |
| 201 | pushing rod, | 202 | slideway structure, |
| 300 | bag loading apparatus, | 301 | bag placement mechanism, |
| 302 | bag conveying mechanism, | 303 | bag transfer mechanism, |
| 400 | bag receiving apparatus, | 401 | support assembly, |
| 4011 | first support plate, | 4012 | second support plate, |
| 4013 | connecting plate, | 4014 | first end plate, |
| 4015 | second end plate, | 4016 | rotation shaft, |
| 402 | bag holder, | 405 | first connecting rod, |
| 406 | second connecting rod, | 407 | slide plate, |
| 408 | driving ring, | 4081 | cam groove, |
| 40811 | cam, | 409 | driving head, |
| 410 | drive motor, | 500 | output mechanism, |
| 600 | sealing mechanism. | | |

DETAILED DESCRIPTION OF THE EMBODIMENTS

Technical solutions according to the embodiments of the present application will be described clearly and completely as follows in conjunction with the embodiments of the present application. It is obvious that the described embodiments are only a part of the embodiments of the present application, rather than all of the embodiments. All the other embodiments obtained by those skilled in the art based on the embodiments of the present application without any creative work belong to the scope of protection of the present application.

When used for material packaging, a packaging bag is opened first, and then the material to be packaged is put into the packaging bag. Finally, an opening of the packaging bag is sealed. Since the packaging bag is of a light and soft material, an opening of the packaging bag is generally in a closed state. When the packaging bag is opened manually, the opening of the packaging bag has to be pulled open with a friction force. A human hand may easily slip on the packaging bag, therefore the efficiency of manual bag opening is relatively low. For large-scale production lines, manual bag opening and manual material filling are not appropriate any more. Hence, bag packaging equipment has emerged. The existing bag packaging equipment includes a bag loading apparatus and a bag receiving apparatus. The bag loading apparatus opens the opening of the packaging bag and loads the packaging bag onto the bag receiving apparatus. For example, suction cups suck two sides of the opening of the packaging bag, and move in opposite directions, thus the opening of the packaging bag is open. Then, the suction cups move close to the bag receiving apparatus to put the packaging bag onto the bag receiving apparatus. The bag receiving apparatus keeps the opening of the packaging bag in an opened state, and the material is manually filled into the packaging bag. Then, the packaging bag is taken off the bag receiving apparatus and is sealed, thereby the packaging of the material is finished. With the existing bag packaging equipment, the opening of the packaging bag can be opened faster, and the operation efficiency has been improved. However, when the material is produced by the production lines in large batches, the efficiency of the manual material filling is relatively low, and as a result, the packaging cannot catch up with the production lines.

Figure 2:
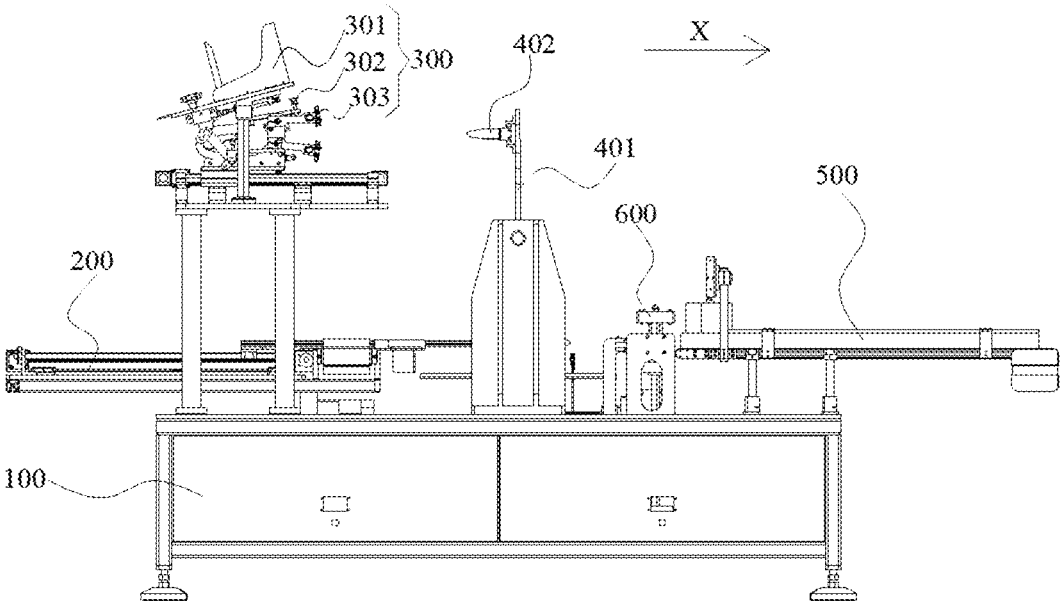
FIG. 2 is a schematic front view showing the structure of the packaging equipment according to the present application.
Figure 3:
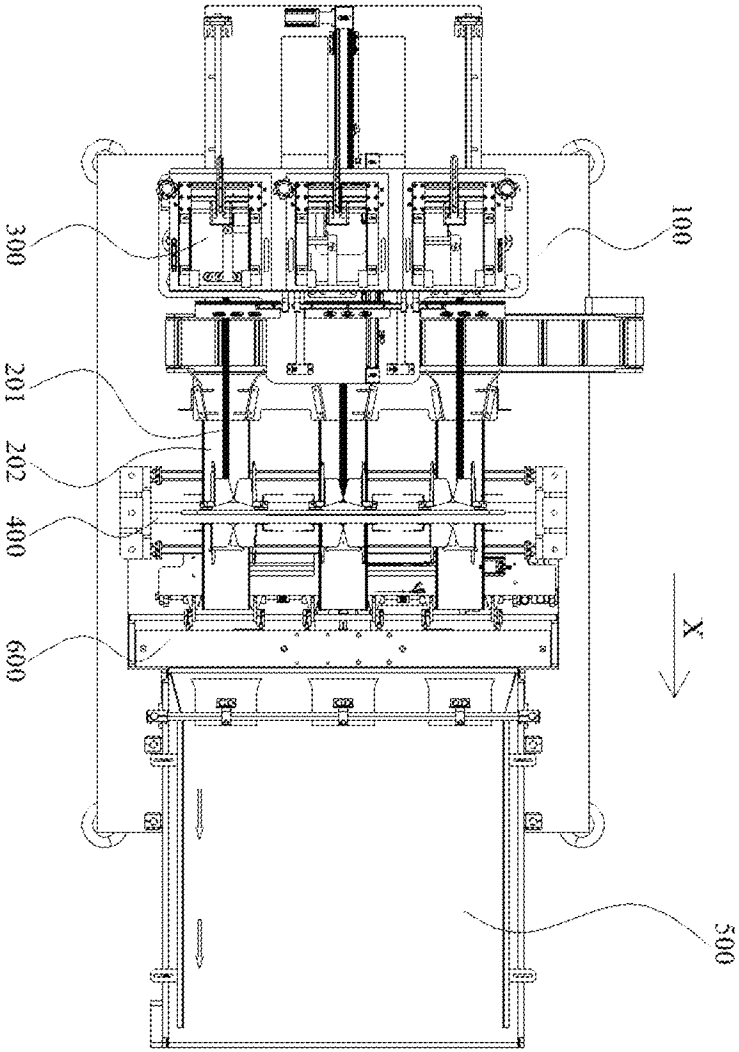
FIG. 3 is a schematic top view showing the structure of the packaging equipment according to the present application.

As shown in FIG. 1 to FIG. 3, packaging equipment according to an embodiment of the present application includes a frame 100, and a material filling apparatus 200, a bag loading apparatus 300, and a bag receiving apparatus 400 that are arranged on the frame 100.

As shown in FIG. 2, the material filling apparatus 200 may be a conveyor belt, a robotic arm, or a material pushing apparatus. In an example, a material filling direction of the material filling apparatus is denoted by an X direction in FIG. 2 and FIG. 3. In an example, the material pushing apparatus includes a pushing rod 201 and a slideway structure 202. The slideway structure is fixed on the frame 100, and the pushing rod 201 cooperates with the slideway structure 202 in a slidable manner. The material to be packaged enters the slideway structure 202, and the pushing rod pushes the material in the slideway structure 202 into the packaging bag, and pushes both the material and the packaging bag away from the bag receiving apparatus 400.

The bag loading apparatus 300 includes a bag placement mechanism 301, a bag conveying mechanism 302, and a bag transfer mechanism 303 that are arranged on the frame 100 along the material filling direction. The bag placement mechanism 301 is configured to store the packaging bag. The bag conveying mechanism 302 is configured to convey the packaging bag inside the bag placement mechanism 301 to the bag transfer mechanism 303. The bag transfer mechanism 303 is configured to load the packaging bag onto a bag holder 402. The bag loading apparatus 300 may load the packaging bag onto the bag holder 402 along a horizontal direction or a vertical direction.

The bag receiving apparatus 400 includes a support assembly 401 and multiple bag holders 402. The support assembly 401 is rotatably arranged on the frame 100, and the multiple bag holders 402 are symmetrically arranged on the support assembly 401 with respect to a rotation axis of the support assembly 401. The rotation axis of the support assembly 401 is perpendicular to the material filling direction, and multiple bag holders 402 may be provided along the rotation axis of the support assembly 401.

The support assembly 401 may be a support plate or a support rod. One or more support plates may be provided, or one or more support rods may be provided. When the support assembly 401 employs the support plate, a lightening hole is provided on the support plate to reduce the moment of inertia of the rotating support plate. The rotating support assembly 401 drives the multiple bag holders 402 to rotate, such that a position of each bag holder 402 switches between a bag loading station and a material filling position. The bag holder 402 can keep an opening of the packaging bag open. In an embodiment, each bag holder 402 includes a first moving plate, a second moving plate, and a linear motor that are arranged on the support plate. The first moving plate and the second moving plate are arranged on the support plate in a slidable manner, and the linear motor drives the first moving plate and the second moving plate to move close to or away from each other. Alternatively, each bag holder 402 is a mechanical clamping body. The mechanical clamping body includes two clamping members that are symmetrically arranged. The two clamping members clamp the packaging bag at two ends of an outer side of the opening of the packaging bag. The two clamping members move towards each other to squeeze the packaging bag to open the opening of the packaging bag, and move away from each other to stretch the packaging bag to close the opening of the packaging bag. After the material is filled, the clamping members release the packaging bag, such that the packaging bag can be conveyed to other positions.

When each bag holder 402 rotates to the bag loading station along with the support assembly 401, the linear motor drives the first moving plate and the second moving plate to move close to each other, such that the first moving plate and the second moving plate can be easily inserted into the packaging bag. At the bag loading station, the bag loading apparatus 300 opens the opening of the packaging bag and loads the packaging bag onto the first moving plate and the second moving plate, such that the first moving plate and the second moving plate are at least partially located inside the packaging bag. Then the linear motor drives the first moving plate and the second moving plate to move away from each other and contact the packaging bag, such that the first moving plate and the second moving plate can keep the opening of the packaging bag open.

Alternatively, the first moving plate and the second moving plate are hingedly connected to the support assembly 401. An air cylinder is provided on the support assembly 401, and the air cylinder drives the first moving plate and the second moving plate to rotate close to or away from each other at the same time, thereby achieving the above functions.

The support assembly 401 rotates to make the first moving plate and the second moving plate move to the material filling position, so that the packaging bag is moved to the material filling position.

At the material filling position, the opening of the packaging bag faces the material filling apparatus 200, and the material filling apparatus 200 fills the material into the packaging bag. In an embodiment, the material filling apparatus 200 is a conveyor belt, and the material to be packaged is conveyed to the opening of the packaging bag and is filled into the packaging bag on the conveyor belt. In an embodiment, the material filling apparatus is a robotic arm, and the robotic arm grabs the material to be packaged and puts the material into the packaging bag.

After the material is filled into the packaging bag, the linear motor drives the first moving plate and the second moving plate to move close to each other, such that the packaging bag stops contacting the first moving plate and the second moving plate. The packaging bag is conveyed to the sealing mechanism 600 automatically or manually.

The sealing mechanism 600 seals the packaging bag getting off the bag receiving apparatus 400. Then the packaging bag is conveyed to a next workstation by the output mechanism 500. The sealing mechanism 600 may be a heat sealer or a press sealer, which is determined according to the type of the packaging bag.

The output mechanism 500 may be a conveyor belt, a turntable, a robotic arm or the like.

The rotation axis of the support assembly 401 is perpendicular to the X direction. In this way, a direction of the opening of the packaging bag can be regulated by a rotating angle of the support assembly 401. In an embodiment, as shown in FIG. 2, the support assembly 401 is in a vertical state. At this time, the bag holder 402 is at the bag loading station, and the bag loading station 300 loads the packaging bag onto the bag holder 402. At this time, the opening of the packaging bag is in the X direction. The support assembly 401 rotates close to the bag loading apparatus 300. When the support assembly 401 rotates to be in a horizontal state, the opening of the packaging bag is in a direction perpendicular to the X direction. The packaging bag is in a vertical state and is at a first material filling station. When the packaging bag is in the vertical state, bulk material such as walnuts, candies, salts, liquids or the like can be easily packaged. The bulk material falls into the packaging bag and are concentrated at a bottom of the packaging bag due to gravity, which facilitates packaging of the bulk material. When the support assembly 401 continues to rotate to be in the vertical state, the opening of the packaging bag is in a direction opposite to the X direction. The packaging bag is in the horizontal state and is at a second material filling station. When the packaging bag is in the horizontal state, relatively regular material such as chocolates, soaps, books or the like can be packaged. The material is horizontally pushed into the packaging bag along the X direction.

Figure 4:
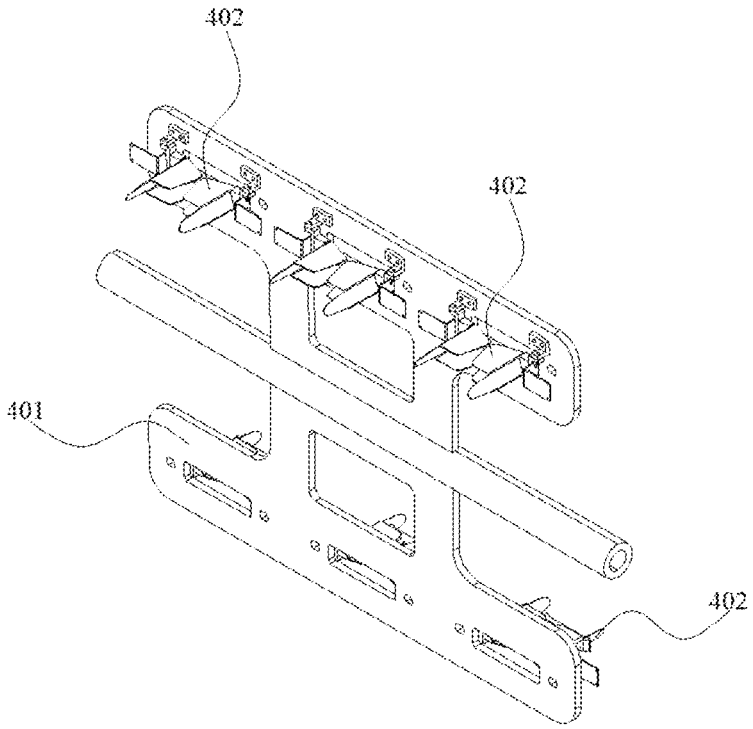
FIG. 4 is a schematic perspective view showing the structure of a bag receiving apparatus according to a first embodiment of the present application.
Figure 5:
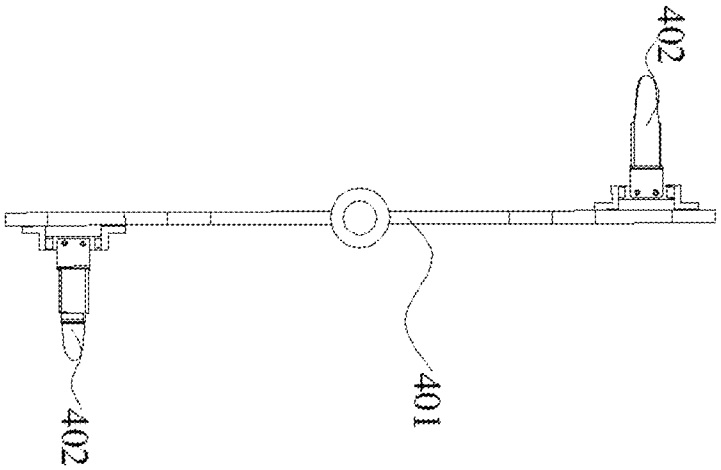
FIG. 5 is a schematic front view showing the structure of the bag receiving apparatus according to the first embodiment of the present application.
Figure 6:
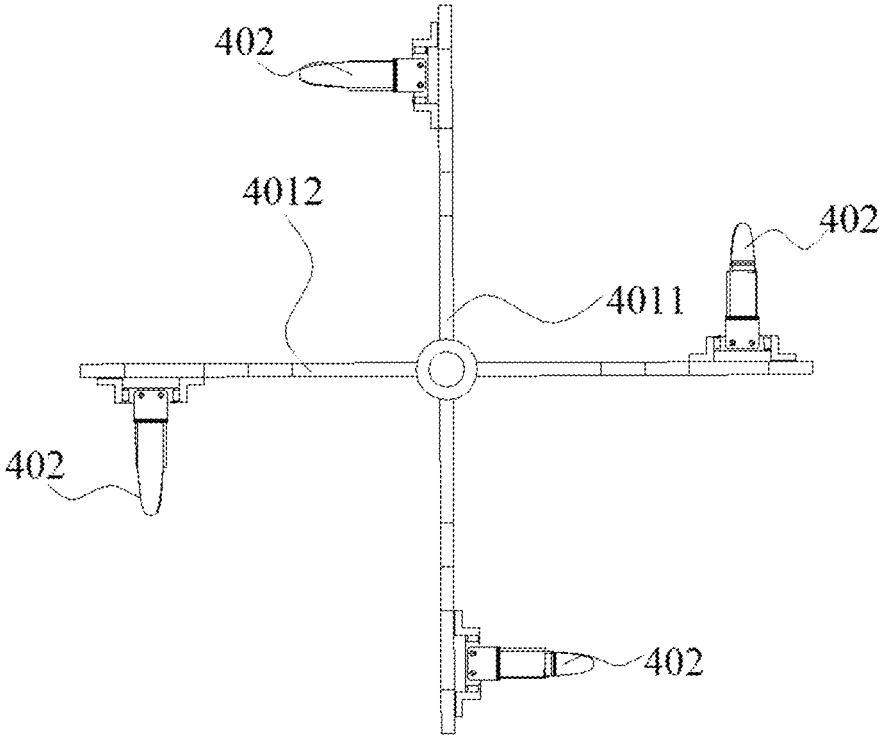
FIG. 6 is a schematic front view showing the structure of a bag receiving apparatus according to a second embodiment of the present application.

With more bag holders 402, the packaging efficiency can be further increased. In an embodiment, referring to FIG. 4, FIG. 5, and FIG. 6, the support assembly 401 includes multiple support plates that are evenly arranged around the rotation axis, where the term "multiple" refers to two or more than two. In this case, since the rotation axis of the support assembly 401 is parallel to a direction along which the multiple support plates are arranged in parallel, the added support plates do not increase a radius of rotation of the support assembly 401. In this way, a space occupied by the equipment according to the present application remains the same while multiple bags are filled at the same time. The bag packaging becomes more efficient within a limited space, while a height of the frame of the equipment needs not to be adjusted.

In an embodiment, when the support assembly 401 only includes a first support plate 4011, the bag holder 402 loaded with the packaging bag is at the bag loading station and the second material filling station. When the packaging bag at the second material filling station is filled with the material and gets off the bag holder 402, the bag holder 402 at the bag loading station rotates by 180° to the second material filling station for material filling.

When the support assembly 401 further includes a second support plate 4012, where an angle between the second support plate 4012 and the first support plate 4011 along a circumferential direction of the rotation axis is 90°, the bag holder 402 on the first support plate 4011 loaded with the packaging bag is at the bag loading station and the second material filling station, and the bag holder 402 on the second support plate 4012 loaded with the packaging bag is at the first material filling station. After the material is filled into the packaging bag on the first support plate 4011 at the second material filling station, the packaging bag on the second support plate 4012 at the first material filling station rotates by 90° to the second material filling station for material filling.

Further, based on the above embodiments, an angle between each two adjacent support plates along the circumferential direction of the rotation axis may be regulated by those skilled in the art into 30°, 45°, 60°, or 90°, which is not described in detail herein.

Similarly, more bag holders 402 on the support assembly 401 lead to a higher operation efficiency of the packaging equipment. For example, when the multiple bag holders 402 are provided along an axial direction of the rotation axis, multiple bag loading apparatuses 300 and multiple material filling apparatuses 200 are provided on the frame 100 in one-to-one correspondence to the multiple bag holders 402, such that multiple packaging bags are loaded at one time, so as to further enhancing the packaging efficiency.

Figure 7:
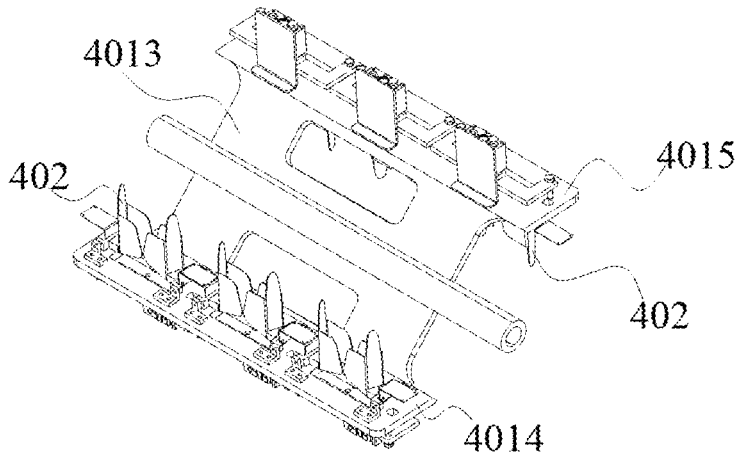
FIG. 7 is a schematic perspective view showing the structure of a bag receiving apparatus according to a third embodiment of the present application.
Figure 8:
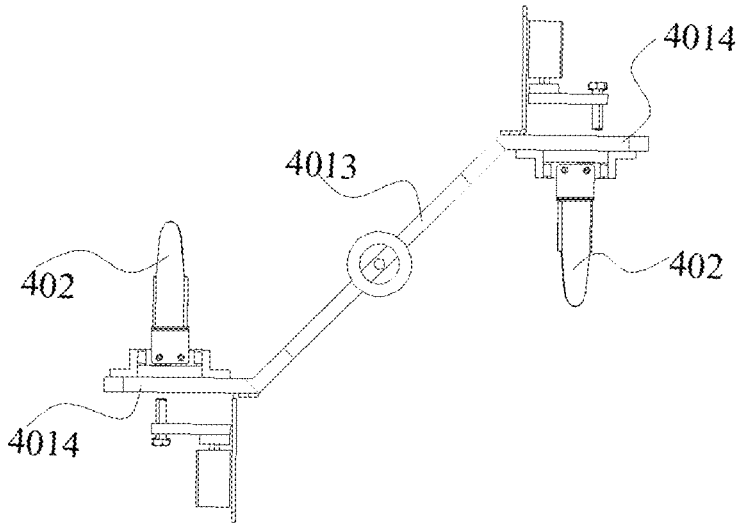
FIG. 8 is a schematic front view showing the structure of the bag receiving apparatus according to the third embodiment of the present application.

In an embodiment, referring to FIG. 7 and FIG. 8, the support assembly 401 includes a connecting plate 4013, and the connecting plate 4013 is rotatably arranged on the frame 100. Two ends of the connecting plate 4013 that are symmetric with respect to the rotation axis are respectively bent by 45° along a rotation direction of the connecting plate 4013 to form a first end plate 4014 and a second end plate 4015, and the multiple bag holder 402 are arranged on the first end plate 4014 and the second end plate 4015 symmetrically with respect to the rotation axis. With such design, the packaging bag is in the vertical state at the second material filling station, making it easier to package bulk materials at the second material filling station.

In an example, when the multiple bag holders 402 on the first end plate 4014 and the second end plate 4015 are rotating along with the connecting plate 4013 to the bag loading station, the packaging bag may be loaded onto the multiple bag holders 402 along the vertical direction. The bag loading apparatus 300 may load the packaging bag onto the bag holder 402 along a direction away from the ground, or along a direction towards the ground.

When the multiple bag holders 402 are arranged on the support assembly 401 symmetrically with respect to the rotation axis of the support assembly 401, and the multiple bag holders 402 can be switched between the bag loading station and the material filling station, the bag receiving apparatus may occupy a relatively large space and may have a large moment of inertia, and therefore more energy is consumed for driving the bag receiving apparatus to rotate.

A technical solution is provided according to an embodiment of the present application to solve the above problem. Retractable packaging machinery according to an embodiment of the present application includes a frame 100, and a material filling apparatus 200, a bag loading apparatus 300, and a bag receiving apparatus 400 that are arranged on the frame 100. The structures of the frame 100 and the material filling apparatus 200 may be provided referring to the above embodiments.

In an example, the bag receiving apparatus 400 includes multiple bag holders 402 and a retractable mechanism. The retractable mechanism is rotatably arranged on the frame 100, and the multiple bag holders 402 are arranged on the retractable mechanism symmetrically with respect to a rotation axis of the retractable mechanism. The retractable mechanism is configured to drive the multiple bag holders 402 to move close to or away from the rotation axis. In an example, the retractable mechanism may be a pneumatic push rod, a hydraulic cylinder, or a cam driven by a motor. A rotation shaft 4016 is provided on the frame. The pneumatic push rod is fixed on the rotation shaft 4016, and a telescopic rod of the pneumatic push rod is fixedly connected to the multiple bag holders 402. When the pneumatic push rod rotates along with the rotation shaft 4016 on the frame 100, the multiple bag holders 402 rotates along with an air cylinder. When the telescopic rod of the pneumatic push rod moves back and forth, the multiple bag holders 402 moves away from or close to a rotation axis of a base of the air cylinder. In another embodiment, the retractable mechanism includes a guide structure, a first support plate 4011, a second support plate 4012, and a linear actuator. The guide structure may be a slide rail, a guide rod or the like, and the linear actuator may be an air cylinder, a hydraulic cylinder, a linear motor or other devices that can output a linear motion. For example, the guide structure is a guide rod. The guide rod is fixedly connected to the rotation shaft 4016, and the air cylinder is fixed on the guide rod. The multiple bag holders 402 are mounted on the first support plate 4011 and the second support plate 4012, and the first support plate 4011 and the second support plate 4012 cooperate with the guide rod in a slidable manner. A telescopic rod of the air cylinder is connected to the first support plate 4011 and the second support plate 4012. The air cylinder moves back and forth to drive the first support plate 4011 and the second support plate 4012 to slide on the guide rod, thereby driving the multiple bag holders 402 to slide on the guide rod.

The retractable mechanism is rotatably arranged on the frame, and the rotation axis of the retractable mechanism is perpendicular to the material filling direction of the material filling apparatus 200. During rotation of the multiple bag holders 402 from the bag loading station to the material filling station, the retractable mechanism drives a distance between the multiple bag holders 402 at two sides of the rotation axis to decrease first and then increase, which makes a radius of rotation of the bag receiving apparatus 400 decrease first and then increase. In this way, a space occupied by the bag receiving apparatus 400 is saved, and a moment of inertia of the bag receiving apparatus 400 can be temporarily reduced, thereby reducing energy consumption for driving the bag receiving apparatus 400, and improving the using safety of the packaging equipment.

Figure 9:
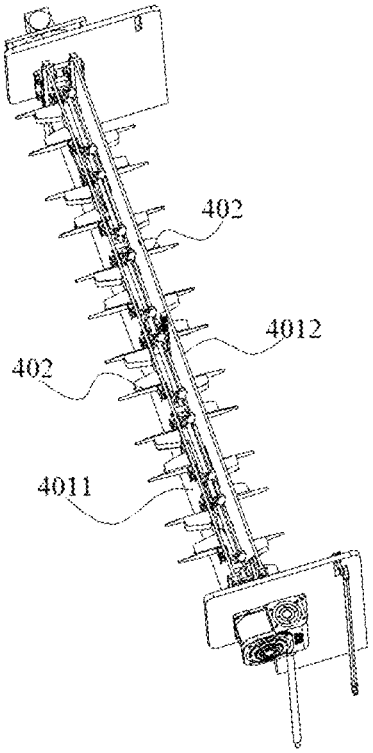
FIG. 9 is a schematic perspective view showing the structure of a bag receiving apparatus according to a fourth embodiment of the present application.
Figure 10:
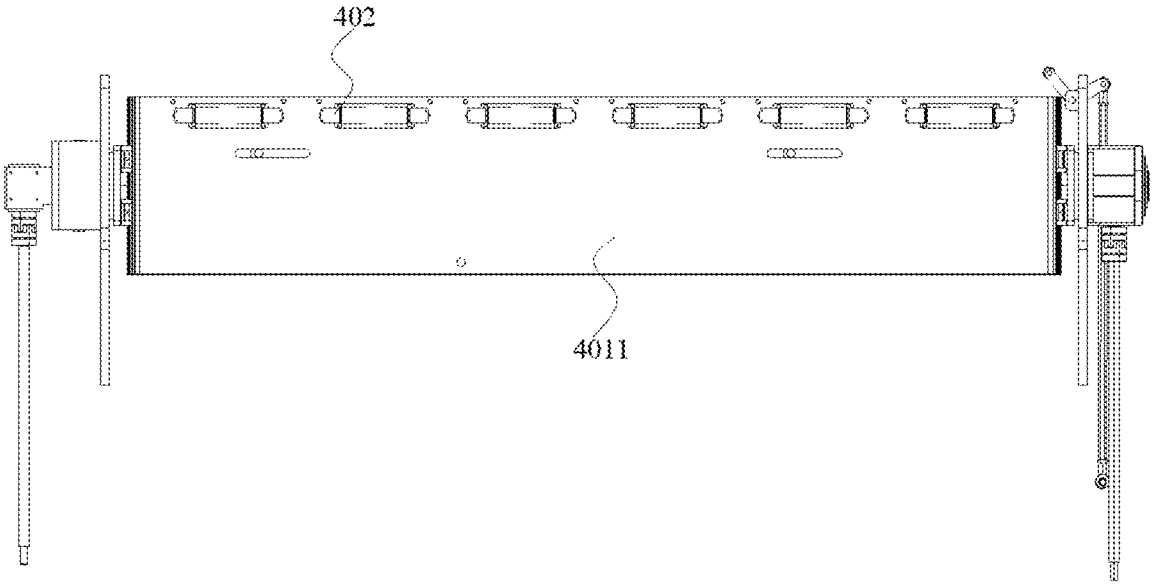
FIG. 10 is a schematic front view showing the structure of the bag receiving apparatus according to the fourth embodiment of the present application.
Figure 11:
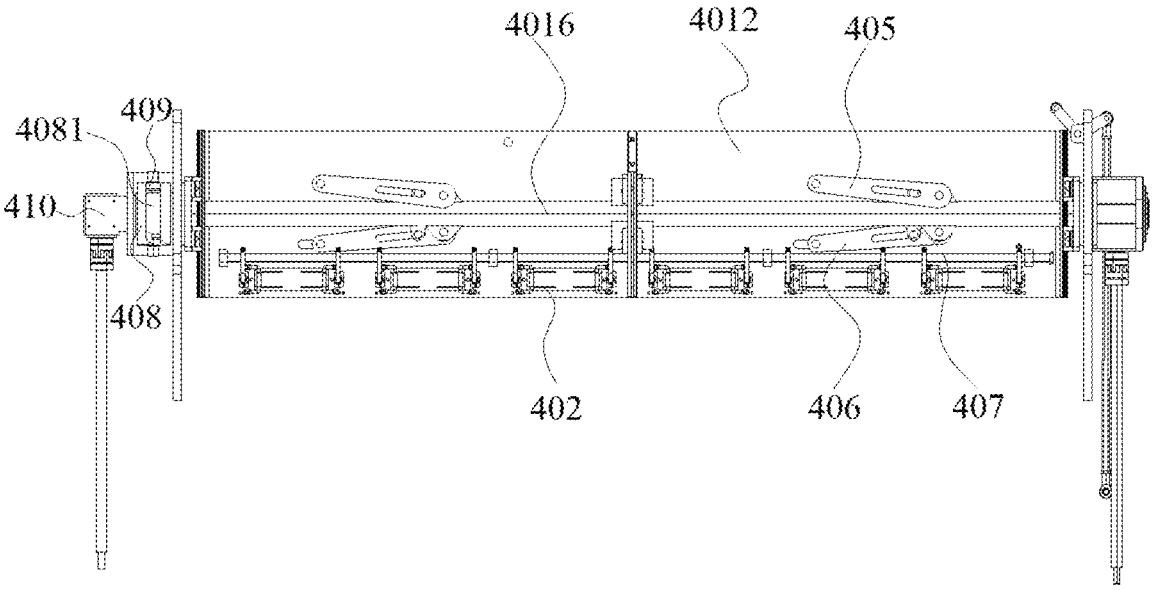
FIG. 11 is a schematic front view showing the structure of the bag receiving apparatus according to the fourth embodiment of the present application without a first support assembly.

In an embodiment, as shown in FIG. 9 to FIG. 11, the retractable mechanism includes a rotation shaft 4016, a first support plate 4011, a second support plate 4012, and a driving mechanism. The rotation shaft 4016 is rotatably arranged on the frame 100, and the first support plate 4011 and the second support plate 4012 are arranged at two sides of the rotation shaft 4016 symmetrically with respect to a plane where a rotation axis of the rotation shaft is. In other words, the first support plate 4011 and the second support plate 4012 are arranged in parallel, and the rotation shaft is located between the first support plate 4011 and the second support plate 4012. The first support plate 4011 and the second support plate 4012 are slidable in a parallel manner along a radial direction of the rotation shaft 4016. The driving mechanism is arranged on the rotation shaft 4016, and the multiple bag holders 402 is arranged on an end portion of the first support plate 4011 and an end portion of the second support plate 4012 symmetrically with respect to the rotation axis of the rotation shaft 4016.

Each of the first support plate 4011 and the second support plate 4012 may be a support plate or a support rod. The first support plate 4011 and the second support plate 4012 may be connected to the rotation shaft 4016 through a slider-rail structure. For example, the first support plate 4011 and the second support plate 4012 are each provided with a slider, and the rotation shaft 4016 is provided with a slide rail. The slider is connected to the slide rail in a slidable manner. Or, the first support plate 4011 and the second support plate 4012 are each provided with a slider, and the rotation shaft 4016 is provided with a slide groove. The slider is connected to the slide groove in a slidable manner.

When the first support plate 4011 and the second support plate 4012 are support plates, a lightening hole may be provided on each support plate to reduce the moment of inertia of the rotating support plate. The rotation shaft 4016 rotates to drive the first support plate 4011 and the second support plate 4012 to rotate, to further drive the bag holder 402 on the first support plate 4011 and the second support plate 4012 to rotate, such that the position of the multiple bag holders 402 can be switched between the bag loading station and the material filling position. The multiple bag holders 402 can keep the opening of the packaging bag open. In an embodiment, when the first support plate 4011 and the second support plate 4012 are both support plates, each bag holder 402 includes a first moving plate, a second moving plate, and a linear motor that are arranged on the support plate. The first moving plate and the second moving plate are arranged on the support plate in a slidable manner, and the linear motor drives the first moving plate and the second moving plate to move close to or away from each other.

When each bag holder 402 rotates to the bag loading station along with the support plate, the linear motor drives the first moving plate and the second moving plate to move close to each other, such that the first moving plate and the second moving plate can be easily inserted into the packaging bag. At the bag loading station, the bag loading apparatus 300 opens the opening of the packaging bag and loads the packaging bag onto the first moving plate and the second moving plate, such that the first moving plate and the second moving plate are at least partially located inside the packaging bag. Then the linear motor drives the first moving plate and the second moving plate to move away from each other and contact the packaging bag, such that the first moving plate and the second moving plate can keep the opening of the packaging bag open.

Alternatively, the first moving plate and the second moving plate are hingedly connected to the support plate. An air cylinder is provided on the support plate, and the air cylinder drives the first moving plate and the second moving plate to rotate close to or away from each other at the same time, thereby achieving the above functions.

To reduce the moment of inertia of the bag receiving apparatus, the radius of rotation of the bag receiving apparatus may be reduced while the mass is constant. In an embodiment, when the bag holder 402 rotates from the bag loading station to the material filling station, the driving mechanism drives the first support plate 4011 and the second support plate 4012 to synchronously slide, such that a distance between the end portion of the first support plate 4011 and the end portion of the second support plate 4012 decreases first and then increases. Half of the distance between the end portion of the first support plate 4011 and the end portion of the second support plate 4012 is regarded as the radius of rotation of the bag receiving apparatus.

In an embodiment, the driving mechanism is a crank linkage mechanism. For example, a rotatable crankshaft is provided on the rotation shaft 4016. One end of each of two connecting rods is hingedly connected to a crank of the crankshaft, and the other end of each of two connecting rods is hingedly connected to the first support plate 4011 and the second support plate 4012 respectively. Through the connecting rods, the crankshaft rotates to drive the first support plate 4011 and the second support plate 4012 to synchronously slide in a parallel manner towards or away from each other along the radial direction of the rotation shaft 4016, such that the distance between the end portion of the first support plate 4011 and the end portion of the second support plate 4012 decreases first and then increases. That is, the bag receiving apparatus is in a retracted state first and then in an expanded state. In another embodiment, the driving mechanism includes a screw and two threaded sleeves, and the two threaded sleeves have opposite threads. The screw is rotatably arranged on the rotation shaft 4016, and the two threaded sleeves are relatively arranged on the first support plate 4011 and the second support plate 4012. The screw is in a threaded connection with the two threaded sleeves. The screw rotates to drive the first support plate 4011 and the second support plate 4012 to synchronously slide in a parallel manner towards or away from each other along the radial direction of the rotation shaft 4016, such that the distance between the end portion of the first support plate 4011 and the end portion of the second support plate 4012 decreases first and then increases. The driving mechanism may be an air cylinder, a hydraulic cylinder, a linear motor or the like. The specific implement can be easily come up with by those skilled in the art, which is not described in detail herein.

In an embodiment, referring to FIG. 11, the driving mechanism includes a first connecting rod 405, a second connecting rod 406, and a driving apparatus. One end of the first connecting rod 405 is hingedly connected to the rotation shaft 4016, and the other end of the first connecting rod 405 cooperates with the first support plate 4011 in a slidable manner along an axial direction of the rotation shaft 4016. One end of the second connecting rod 406 is hingedly connected to the rotation shaft 4016, and the other end of the second connecting rod 406 cooperates with the second support plate 4012 in a slidable manner along the axial direction of the rotation shaft 4016. The driving apparatus is configured to drive the first connecting rod 405 and the second connecting rod 406 to rotate close to or away from the rotation shaft 4016 at the same time. When the first connecting rod 405 and the second connecting rod 406 rotate away from the rotation shaft 4016 at the same time, the other end of the first connecting rod 405 and the other end of the second connecting rod 406 respectively push the first support plate 4011 and the second support plate 4012 to synchronously slide away from each other. When the first connecting rod 405 and the second connecting rod 406 rotate close to the rotation shaft 4016 at the same time, the other end of the first connecting rod 405 and the other end of the second connecting rod 406 respectively push the first support plate 4011 and the second support plate 4012 to synchronously slide towards each other. The driving apparatus may be a telescopic rod or a rotating motor.

As shown in FIG. 11, in an embodiment, the driving apparatus includes a slide plate 407, a push-pull rod, and a driver. The rotation shaft 4016 is a hollow shaft, and the slide plate 407 passes through the rotation shaft 4016 and is arranged on the rotation shaft 4016 in a slidable manner along the axial direction of the rotation shaft 4016. Two ends of the slide plate 407 respectively cooperate with the first connecting rod 405 and the second connecting rod 406 in a slidable manner along an extension direction of the first connecting rod 405 and an extension direction of the second connecting rod 406. The push-pull rod is arranged inside the rotation shaft 4016 and cooperates with the rotation shaft 4016 along the axial direction of the rotation shaft 4016. One end of the push-pull rod is connected to the slide plate 407, and the other end of the push-pull rod is connected to the driver located at an end portion of the rotation shaft 4016. The driver drives the push-pull rod to move back and forth along the axial direction of the rotation shaft 4016 to drive the first connecting rod 405 and the second connecting rod 406 to rotate. When the driver drives the push-pull rod to move back and forth, the other end of the push-pull rod drives the slide plate 407 to move back and forth, and the slide plate 407 drives the first connecting rod 405 and the second connecting rod 406 to rotate. The driver may be an air cylinder, a linear motor, a rack-and-pinion mechanism or other mechanisms that can generate a linear motion.

Figure 12:
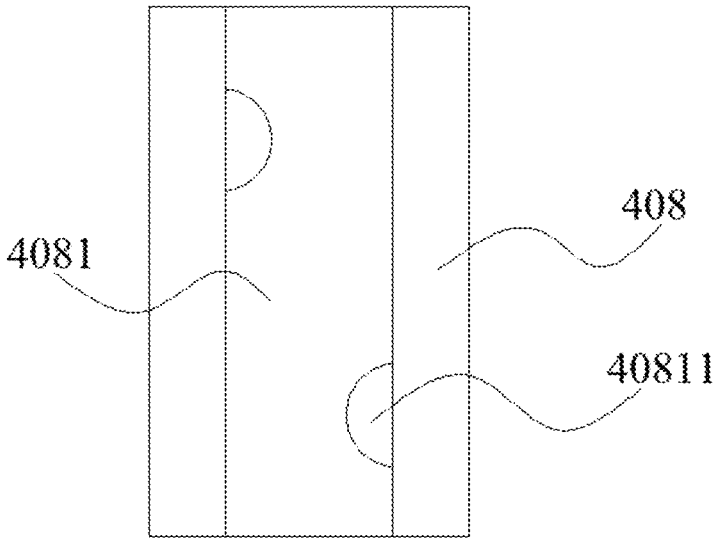
FIG. 12 is a schematic front view showing the structure of a driving ring according to the fourth embodiment of the present application.

In an embodiment, referring to FIG. 11, the driver includes a driving ring 408 and a driving head 409. The driving ring 408 is coaxially connected to the push-pull rod. Referring to FIG. 12, a cam groove 4081 extending along a circumferential direction of the rotation shaft 4016 is provided on an outer ring surface of the driving ring 408, and a cam 40811 extending towards a middle portion of the cam groove 4081 is provided on a side wall of the cam groove 4081. The driving head 409 cooperates with the cam groove in a slidable manner along the circumferential direction of the rotation shaft 4016, and the driving head 409 rotates along the circumferential direction of the rotation shaft 4016 under an external force to drive the driving ring 408 to move back and forth along the axial direction of the rotation shaft 4016. The external force may come from a drive motor 410 or other mechanisms that can generate a rotation. For example, a rotating mechanism interconnected with the rotation shaft 4016 may be provided, such that a rotation angle of the driving head 409 is controlled according to a rotation angle of the rotation shaft 4016. When the driving head 409 relatively slides in the cam groove 4081, the driving head 409 contacts the cam 40811 in the cam groove 4081. At this time, the driving head 409 pushes the cam 40811, such that the driving ring 408 linearly moves along the axial direction of the rotation shaft 4016. When contacting two cams 40811 that are respectively located on two opposite side walls of the cam groove 4081, the driving head 409 pushes the two cams 40811 in opposite directions. In this way, the driving ring 408 moves back and forth along the axial direction of the rotation shaft 4016, thereby further driving the push-pull rod connected to the driving ring 408 to move back and forth along the axial direction of the rotation shaft 4016, so as to drive the first support plate 4011 and the second support plate 4012 to slide.

In an example, when the bag holder 402 switches from the bag loading station to the material filling station, the driving head 409 keeps stationary, and the rotation shaft 4016 rotates. The driving ring 408 rotates along with the rotation shaft 4016, such that the driving head 409 and the driving ring 408 rotate with respect to each other. The driving ring 408 drives the push-pull rod to move with respect to the rotation shaft 4016 along the axial direction, and further drives the first support plate 4011 and the second support plate 4012 to slide. Therefore, a distance between the bag holder 402 and the rotation shaft gradually decreases. That is, the radius of rotation of the bag receiving apparatus 400 decreases during the rotation of the rotation shaft 4016. Alternatively, at the bag loading station, the driving head 409 rotates first under the external force, to make the distance between the bag holder 402 and the rotation shaft decrease. Then the rotation shaft 4016 is driven to rotate. That is, the radius of rotation of the bag receiving apparatus 400 decreases first, and then the rotation shaft 4016 rotates. At the same time when the rotation shaft 4016 rotates, the driving head 409 is driven to synchronously rotate along a same direction, or rotate along with the rotation shaft 4016 along the same direction to some extent, such that the radius of rotation of the bag receiving apparatus 400 keeps decreased during rotation, thereby reducing the moment of inertia and preventing interference.

Figure 13:
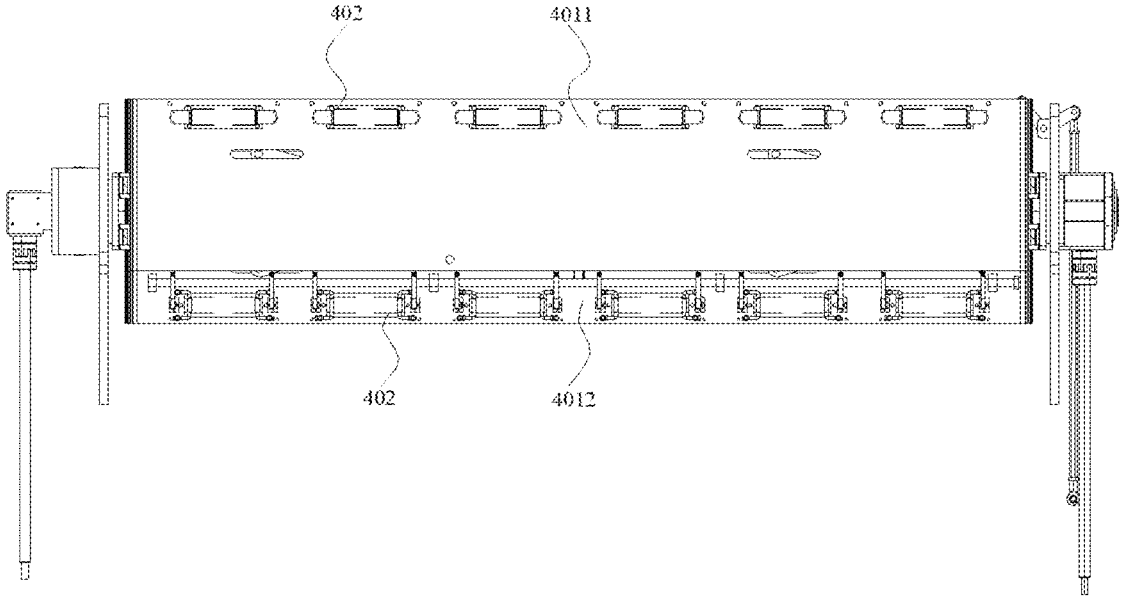
FIG. 13 is a schematic front view showing the structure of the bag receiving apparatus according to the fourth embodiment of the present application in an expanded state.

The first support plate 4011 and the second support plate 4012 may overlap each other or may be arranged in a staggered manner. A plane of symmetry of the first support plate 4011 and the second support plate 4012, i.e. a plane where the rotation axis of the rotation shaft is, is taken as a reference. The term "overlap" refers to that, when the bag receiving apparatus is retracted or expanded, as shown in FIG. 13, an orthographic projection of the first support plate 4011 and an orthographic projection of the second support plate 4012 on the plane of symmetry always overlap each other. The term "arranged in a staggered manner" refers to that, when the bag receiving apparatus is retracted or expanded, the orthographic projection of the first support plate 4011 and the orthographic projection of the second support plate 4012 on the plane of symmetry never overlap each other. To save the space occupied by the bag receiving apparatus, and to better reduce the radius of rotation of the bag receiving apparatus, the first support plate 4011 and the second support plate 4012 are arranged overlapping each other.

To improve the packaging efficiency, referring to FIG. 9 and FIG. 13, the multiple bag holders 402 are provided on the first support plate 4011 and the second support plate 4012 along the axial direction of the rotation shaft 4016, and multiple bag loading apparatuses 300 and multiple material filling apparatuses 200 are provided on the frame 100 in one-to-one correspondence to the multiple bag holders 402. With such arrangement, multiple packaging bags can be loaded onto the multiple bag holders 402 at one time at the bag loading station, and multiple packaging bags can be filled with the material at one time at the material filling station. Therefore, the packaging efficiency is improved, while the radius of rotation of the bag receiving apparatus is not increased.

The embodiments hereinabove are only preferred embodiments of the present application. It should be noted that, the above preferred embodiments should not be construed as limitations to the present application, and the scope of protection of the present application is defined by the claims of the present application. For those skilled in the art, a few of modifications and improvements may be made without departing from the spirit and scope of the present application, and these modifications and improvements are also deemed to fall into the scope of protection of the present application.

The invention claimed is:

1. Packaging equipment, comprising a frame, and a material filling apparatus, a bag loading apparatus, and a bag receiving apparatus that are arranged on the frame, wherein the bag receiving apparatus comprises a support assembly and a plurality of bag holders, the support assembly is rotatably arranged on the frame, and the plurality of bag holders are symmetrically arranged on the support assembly with respect to a rotation axis of the support assembly;

the bag loading apparatus is configured to convey a packaging bag to the plurality of the bag holders at a bag loading station, and the bag receiving apparatus is configured to drive the packaging bag to rotate from the bag loading station to the material filling station; and the material filling apparatus is configured to fill material into the packaging bag, and a material filling direction of the material filling apparatus is perpendicular to the rotation axis of the support assembly.

2. The packaging equipment according to claim 1, wherein the support assembly comprises a support plate, and the plurality of bag holders are arranged on the support plate.

3. The packaging equipment according to claim 2, wherein two or more bag holders are provided on the support plate along an axial direction of the rotation axis, and a plurality of bag loading apparatuses and a plurality of material filling apparatuses are provided on the frame in one-to-one correspondence to the two or more bag holders.

4. The packaging equipment according to claim 2, wherein a plurality of support plates are provided, and the plurality of support plates are evenly arranged around the rotation axis.

5. The packaging equipment according to claim 4, wherein an angle between each two adjacent support plates along a circumferential direction of the rotation axis is 30°, 45°, 60°, or 90°.

6. The packaging equipment according to claim 4, wherein each of the plurality of support plates comprises a connecting plate, two ends of the connecting plate that are symmetric with respect to the rotation axis are respectively bent by 45° along a rotation direction of the connecting plate to form a first end plate and a second end plate, and the plurality of bag holders are symmetrically arranged on the first end plate and the second end plate with respect to the rotation axis.

7. The packaging equipment according to claim 6, wherein the bag loading apparatus is configured to load the packaging bag onto the plurality of bag holders along a vertical direction when the plurality of bag holders are at the bag loading station.

8. The packaging equipment according to claim 1, wherein the material filling apparatus comprises a pushing rod and a slideway structure, the pushing rod cooperates with the slideway structure in a slidable manner, and the pushing rod is configured to push the material in the slideway structure into the packaging bag whose opening is in an open state;

the packaging equipment comprises an output mechanism arranged on the frame, and the output mechanism is configured to convey the packaging bag filled with the material;

the packaging equipment comprises a sealing mechanism arranged on the frame, and the sealing mechanism is configured to seal the packaging bag filled with the material;

the bag loading apparatus comprises a bag placement mechanism, a bag conveying mechanism, and a bag transfer mechanism that are arranged on the frame along the material filling direction, wherein the bag placement mechanism is configured to store the packaging bag, the bag conveying mechanism is configured to convey the packaging bag inside the bag placement mechanism to the bag transfer mechanism, and the bag transfer mechanism is configured to load the packaging bag onto the plurality of bag holders;

each of the plurality of bag holders comprises a first moving plate and a second moving plate that are symmetrically arranged on the support assembly, and the first moving plate and the second moving plate are hingedly connected to the support assembly; and each of the plurality of bag holders comprises an air cylinder arranged on the support assembly, and the air cylinder is configured to drive the first moving plate and the second moving plate to rotate towards or away from each other at the same time.

9. The packaging equipment according to claim 1, wherein the support assembly is a retractable mechanism;

the retractable mechanism is configured to drive the bag holders to move close to or away from the rotation axis; and during rotation of the plurality of bag holders from the bag loading station to the material filling station, the retractable mechanism is configured to drive a distance between the plurality of bag holders at two sides of the rotation axis to decrease first and then increase.

10. The packaging equipment according to claim 9, wherein the retractable mechanism comprises a rotation shaft, a driving mechanism, a first support plate, and a second support plate;

the rotation shaft is rotatably arranged on the frame, and the first support plate and the second support plate are arranged on the rotation shaft in a slidable manner; and the driving mechanism is configured to drive the first support plate and the second support plate to slide in parallel along a direction perpendicular to the rotation axis, and the plurality of bag holders are symmetrically arranged on an end portion of the first support plate and an end portion of the second support plate with respect to an rotation axis of the rotation shaft.

11. The packaging equipment according to claim 10, wherein an output end of the driving mechanism is connected to the first support plate and the second support plate, and the retractable mechanism comprises a guide structure provided on the rotation shaft; and the first support plate and the second support plate cooperate with the guide structure in a slidable manner, and the driving mechanism is configured to drive the plurality of bag holders to slide on the guide structure close to or away from the rotation axis.

12. The packaging equipment according to claim 10, wherein the first support plate and the second support plate are arranged at two sides of the rotation shaft, the first support plate and the second support plate are parallel to each other, and the rotation shaft is arranged between the first support plate and the second support plate.

13. The packaging equipment according to claim 12, wherein the driving mechanism comprises a first connecting rod, a second connecting rod, and a driving apparatus;

one end of the first connecting rod is hingedly connected to the rotation shaft, and the other end of the first connecting rod cooperates with the first support plate in a slidable manner along an axial direction of the rotation shaft;

one end of the second connecting rod is hingedly connected to the rotation shaft, and the other end of the second connecting rod cooperates with the second support plate in a slidable manner along the axial direction of the rotation shaft; and the driving apparatus is configured to drive the first connecting rod and the second connecting rod to rotate close to or away from the rotation shaft at the same time.

14. The packaging equipment according to claim 13, wherein the driving apparatus comprises a slide plate, a push-pull rod, and a driver;

the rotation shaft is a hollow shaft, the slide plate passes through the rotation shaft and is arranged on the rotation shaft in a slidable manner along the axial direction of the rotation shaft, and two ends of the slide plate respectively cooperates with the first connecting rod and the second connecting rod in a slidable manner along an extension direction of the first connecting rod and an extension direction of the second connecting rod;

the push-pull rod is arranged inside the rotation shaft and cooperates with the rotation shaft along the axial direction of the rotation shaft, one end of the push-pull rod is fixedly connected to the slide plate, and the other end of the push-pull rod is connected to the driver located at an end portion of the rotation shaft; and the driver is configured to drive the push-pull rod to move back and forth along the axial direction of the rotation shaft to drive the first connecting rod and the second connecting rod to rotate.

15. The packaging equipment according to claim 14, wherein the driver comprises a driving ring and a driving head;

the driving ring is coaxially connected to the push-pull rod, and a cam groove extending along a circumferential direction of the rotation shaft is provided on an outer ring surface of the driving ring, and the driving head is connected to the cam groove in a slidable manner along the circumferential direction of the rotation shaft; and the driving head is configured to rotate along the circumferential direction of the rotation shaft under an external force to drive the driving ring to move back and forth along the axial direction of the rotation shaft; or the driving head is stationary, and the driving ring is configured to rotate along with the rotation shaft to be driven to move back and forth along the axial direction of the rotation shaft.

* * * * *